US005980536A

United States Patent [19]

Jamali

[11] Patent Number: 5,980,536

[45] Date of Patent: Nov. 9, 1999

[54] WAX CONTAINER AND APPLICATION KIT

[76] Inventor: Parvin Jamali, 7185-A Calabria Ct, San Diego, Calif. 92122

[21] Appl. No.: 09/045,884

[22] Filed: Mar. 23, 1998

[51] Int. Cl.[6] ..... A61B 17/00

[52] U.S. Cl. ..... 606/134

[58] Field of Search ..... 606/134, 133, 606/131; 401/1, 2, 209, 208; 451/525; 222/174, 146.5; 219/228, 242; 30/140

[56] References Cited

U.S. PATENT DOCUMENTS 1,846,613 2/1932 Rosenthal ..... 606/131

3,690,776 9/1972 Zaporoshan ..... 401/1

3,858,985 1/1975 Fiveash ..... 401/2

*Primary Examiner*—Michael Buiz

*Assistant Examiner*—Vikki Trinh

[57] ABSTRACT

A wax container and applicator kit including a cylindrical container having an open top portion. Included is a first applicator member that is sized for positioning through the open top portion of the container. The first applicator member has a handle portion and a body portion. A second applicator member is provided and is elongated and linear. Finally, a third applicator member is included. The third applicator member is elongated, linear and having a size being ⅔ that of the second applicator member.

6 Claims, 2 Drawing Sheets

WAX CONTAINER AND APPLICATION KIT

BACKGROUND OF THE INVENTION

1. Field of the Invention

The present invention relates to a wax container and applicator kit and more particularly pertains to providing a container for body wax and including a plurality of wax applicators.

2. Description of the Prior Art

The use of a wax container is known in the prior art. More specifically, wax containers heretofore devised and utilized for the purpose of storing body wax are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,279,080 to Muller and Hauck discloses a hair removal device. U.S. Pat. No. 5,158,765 to Qasem discloses a hair removal composition. U.S. Pat. No. 4,958,951 to Mann discloses hot wax hair remover apparatus. U.S. Pat. No. 4,830,633 to Hori, Matumoto, Yamamoto, Sasaki, and Shida discloses a depilation method. U.S. Pat. No. 4,282,877 to Mathews discloses a hair removing arrangement. Lastly, U.S. Pat. No. Des. 285,155 to Mathews discloses a sheet of hair removing strips.

In this respect, the wax container and applicator kit according to the present invention substantially departs from the conventional concepts and designs of the prior art, and in so doing provides an apparatus primarily developed for the purpose of providing a container for body wax and including a plurality of wax applicators.

Therefore, it can be appreciated that there exists a continuing need for a new and improved wax container and applicator kit which can be used for providing a container for body wax and including a plurality of wax applicators. In this regard, the present invention substantially fulfills this need.

SUMMARY OF THE INVENTION

In view of the foregoing disadvantages inherent in the known types of wax containers now present in the prior art, the present invention provides an improved wax container and applicator kit. As such, the general purpose of the present invention, which will be described subsequently in greater detail, is to provide a new and improved wax container and applicator kit which has all the advantages of the prior art and none of the disadvantages.

To attain this, the present invention essentially comprises a generally cylindrical container that has an open top portion. A first applicator member is provided. The first applicator member is generally rectangular and sized for positioning through the open top portion of the container. The first applicator member has a handle portion and a body portion. The handle portion projecting outwardly from an upper side of the body portion. The first applicator member has a curved edge, a flat edge and a concave edge. Each edge is smoothing a wax within the container onto the skin.

Included is a second applicator member. The second applicator member is elongated and linear. The second applicator member has a first end, a second end and grip portion. The first end is angular and the second end is rounded. The grip portion is formed by a plurality of raised portions encircling the second applicator member. A third applicator member is provided. The third applicator member is elongated, linear and has a size that is ⅔ that of the second applicator member. The third applicator member has a first end, a second end and grip portion. The first end is angular and the second end is rounded. The grip portion is formed by a plurality of raised portions encircling the third applicator member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wax container and applicator kit which has all the advantages of the prior art Wax containers and none of the disadvantages.

It is another object of the present invention to provide a new and improved wax container and applicator kit which may be easily and efficiently manufactured and marketed.

It is a further object of the present invention to provide a new and improved wax container and applicator kit which is of a durable and reliable construction.

An even further object of the present invention is to provide a new and improved wax container and applicator kit which is susceptible of a low cost of manufacture with regard to both materials and labor, and which accordingly is then susceptible of low prices of sale to the consuming public, thereby making such Wax container and applicator kit economically available to the buying public.

Still yet another object of the present invention is to provide a new and improved wax container and applicator kit which provides in the apparatuses and methods of the prior art some of the advantages thereof, while simultaneously overcoming some of the disadvantages normally associated therewith.

Still another object of the present invention is to providing a container for body wax and including a plurality of wax applicators.

Lastly, it is an object of the present invention to provide a new and improved a cylindrical container having an open top portion. Included is a first applicator member that is sized for positioning through the open top portion of the container. The first applicator member has a handle portion and a body portion. A second applicator member is provided and is elongated and linear. Finally, a third applicator member is included. The third applicator member is elongated, linear and having a size being ⅔ that of the second applicator member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
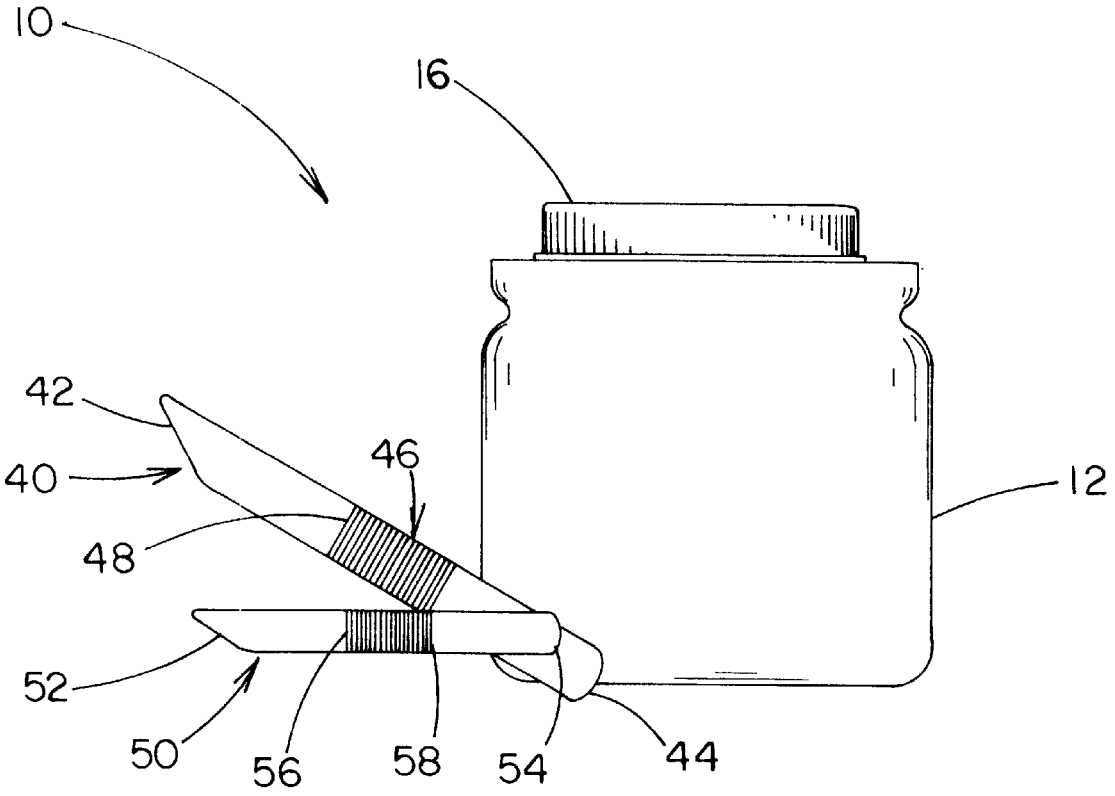
FIG. 1 is a perspective illustration of the preferred embodiment of the wax container and applicator kit constructed in accordance with the principles of the present invention.

With reference now to the drawings, and in particular to FIG. 1 thereof, a new and improved wax container and applicator kit embodying the principles and concepts of the present invention and generally designated by the reference numeral 10 will be described.

The present invention, the new and improved Wax container and applicator kit, is comprised of a plurality of components. Such components in their broadest context include a container and a plurality of applicators. Such components are individually configured and correlated with respect to each other so as to attain the desired objective.

More specifically, the present invention includes a generally cylindrical container 12. The cylindrical container has an open top portion 14. The top portion is covered with a top 16. The container of FIG. 1 is formed of a rigid, microwaveable plastic.

Figure 2:
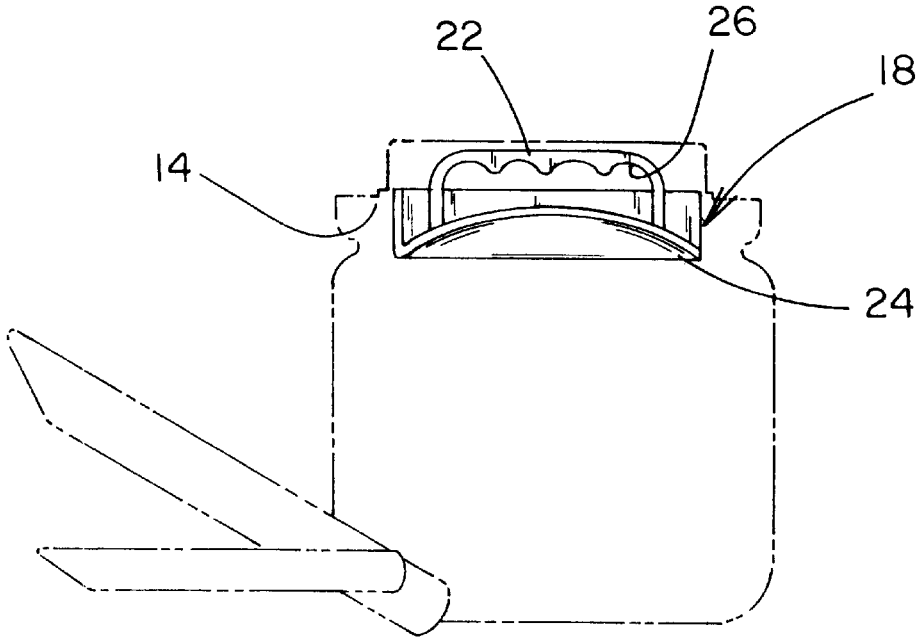
FIG. 2 is a perspective illustration showing the first applicator member positioned within the container.
Figure 3:
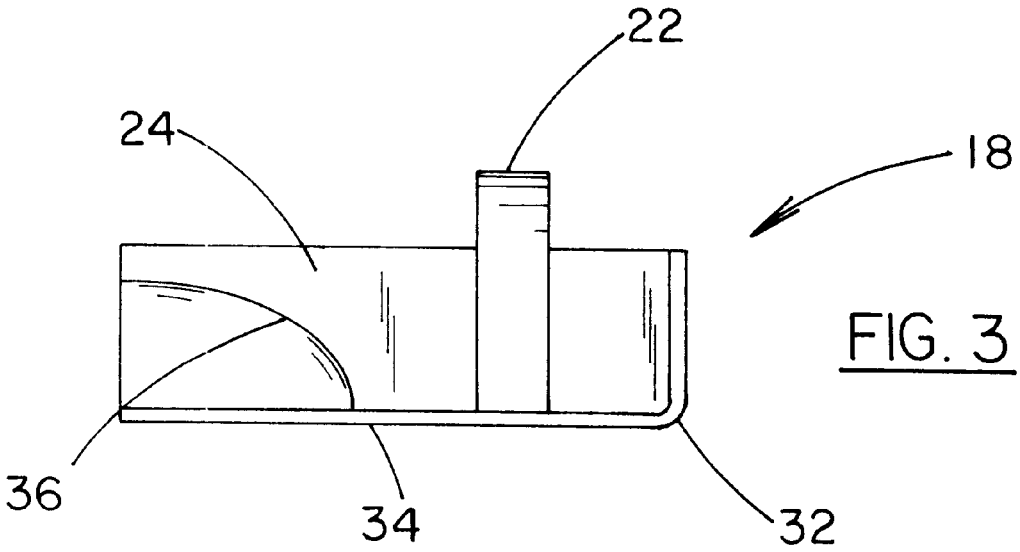
FIG. 3 is a rear view of the first applicator member.
Figure 4:
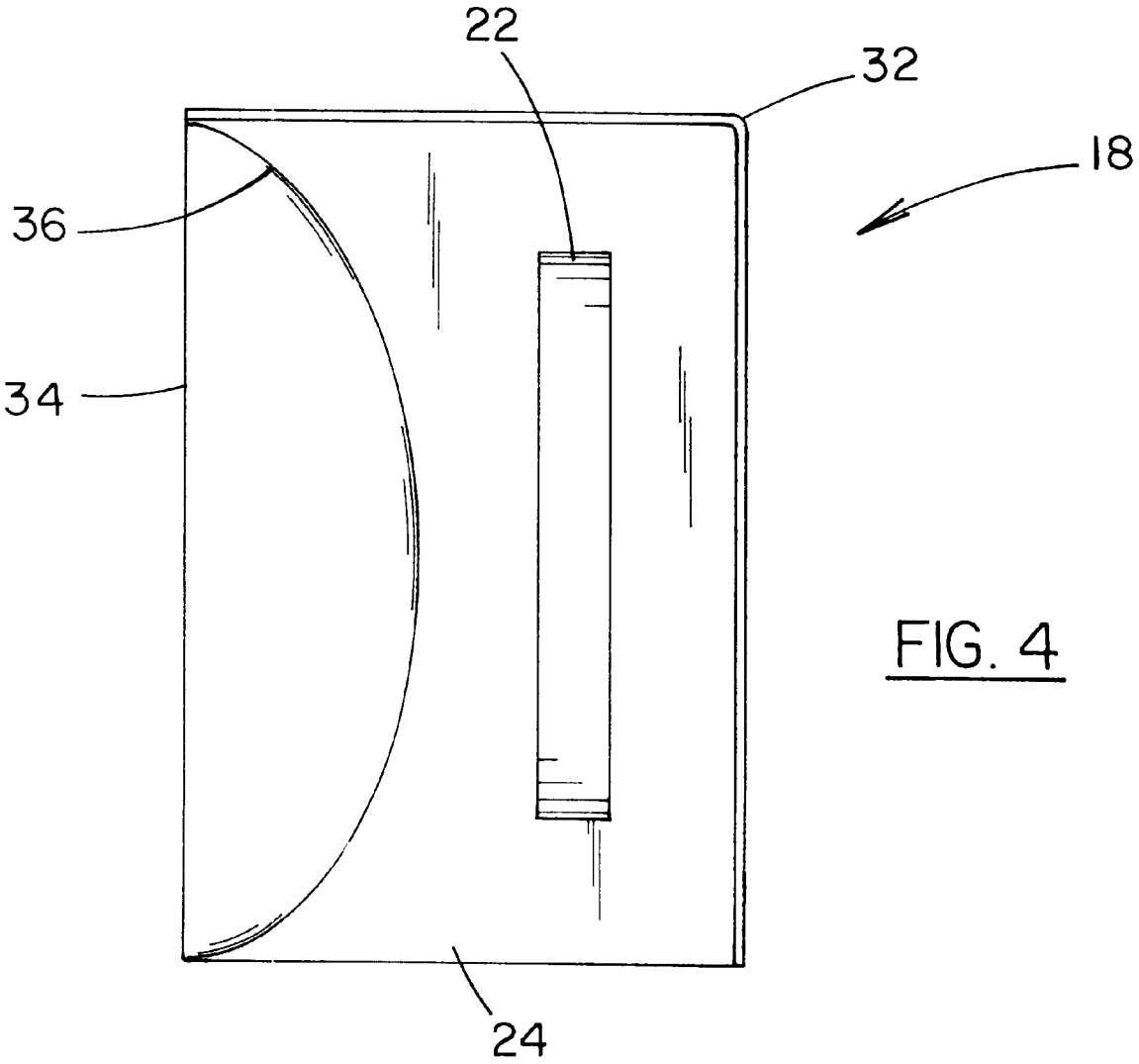
FIG. 4 is a top view of the first applicator member.

As illustrated in FIG. 2, a first applicator member 18 is provided. The first applicator member is generally rectangular and sized for positioning through the open top portion of the container. The first applicator member has a handle portion 22 and a body portion 24. The handle portion projecting outwardly from an upper side of the body portion. The handle portion has a pass through 26 for receiving fingers. The first applicator member has a curved edge 32, a flat edge 34 and a concave edge 36. FIGS. 3 and 4 show each of the edges. Each edge is used for smoothing a wax within the container onto the skin.

Included is a second applicator member 40. The second applicator member, as shown in FIG. 1, is elongated and linear. The second applicator member has a first end 42, a second end 44 and grip portion 46. The first end is angular and the second end is rounded. The grip portion is formed by a plurality of raised portions 48 encircling the second applicator member.

A third applicator member is provided 50. The third applicator member is elongated, linear and has a size that is ⅔ that of the second applicator member. The third applicator member has a first end 52, a second end 54 and grip portion 56. The first end is angular and the second end is rounded. The grip portion is formed by a plurality of raised portions 58 encircling the third applicator member. The second and third applicator members are microwaveable.

The present invention wax container and applicator kit contains a natural wax formula for use on the human body for hair removal. The first applicator has a handle portion and a body portion. The pass through of the handle portion is sized and shaped to allow the three middle fingers to fit comfortable within. Each of the three edges of the first applicator are shaped so as to maneuver a different area of the body. The concave edge is intended for use on the arms and legs. The curved edge is to be used on the back area. The flat edge is for use in the bikini area. Additionally, a pair of elongated applicator members are provided. Each of the pair of elongated applicators have an angled end, a rounded end and a grip portion. The pair of elongated applicators are identical. The only exception is that the second applicator member of the pair is larger than the third applicator member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A wax container and applicator kit comprising in combination:

a generally cylindrical container having an open top portion;

a first applicator member being generally rectangular and sized for positioning through the open top portion of the container, the first applicator member having a handle portion and a body portion, the handle portion projecting outwardly from an upper side of the body portion, the first applicator member having a curved edge, a flat edge and a concave edge, each edge for smoothing a wax within the container onto the skin;

a second applicator member being elongated and linear, the second applicator member having a first end, a second end and grip portion therebetween, the first end being angular and the second end being rounded, the grip portion being formed by a plurality of raised portions encircling the second applicator member; and a third applicator member being elongated, linear and having a size being ⅔ that of the second applicator member, the third applicator member having a first end, a second end and grip portion therebetween, the first end being angular and the second end being rounded, the grip portion being formed by a plurality of raised portions encircling the third applicator member.

2. A wax container and applicator kit comprising:

a cylindrical container having an open top portion;

a first applicator member being sized for positioning through the open top portion of the container, the first applicator member having a handle portion and a body portion, the handle portion projecting outwardly from an upper side of the body portion and the first applicator member having a curved edge, a flat edge and a concave edge, each edge for smoothing a wax within the container onto the skin;

a second applicator member being elongated and linear; and a third applicator member being elongated, linear and having a size being ⅔ that of the second applicator member.

3. The wax container and applicator kit as set forth in claim 2, wherein the second applicator member having a first end, a second end and grip portion therebetween, the first end being angular and the second end being rounded.

4. The wax container and applicator kit as set forth in claim 3, wherein the grip portion being formed by a plurality of raised portions encircling the second applicator member.

5. The wax container and applicator kit as set forth in claim 2, wherein the third applicator member having a first end, a second end and grip portion therebetween.

6. The wax container and applicator kit as set forth in claim 2, wherein the first end being angular and the second end being rounded, the grip portion being formed by a plurality of raised portions encircling the third applicator member.

* * * * *